US009127335B2

(12) United States Patent
Ederyd

(10) Patent No.: US 9,127,335 B2
(45) Date of Patent: Sep. 8, 2015

(54) CEMENTED CARBIDE TOOLS

(75) Inventor: Stefan Ederyd, Saltsjö-Boo (SE)

(73) Assignee: Sandvik Intellectual Property AB, Sandviken (SE)

( * ) Notice: Subject to any disclaimer, the term of this patent is extended or adjusted under 35 U.S.C. 154(b) by 932 days.

(21) Appl. No.: 13/264,390

(22) PCT Filed: Apr. 26, 2010

(86) PCT No.: PCT/SE2010/000109

§ 371 (c)(1),
(2), (4) Date: Dec. 23, 2011

(87) PCT Pub. No.: WO2010/126424

PCT Pub. Date: Nov. 4, 2010

(65) Prior Publication Data

US 2012/0093597 A1 Apr. 19, 2012

(30) Foreign Application Priority Data

Apr. 27, 2009 (SE) ..... 0900559

(51) Int. Cl.

| | |
|---|---|
| ***B22F 3/24*** | (2006.01) |
| ***C22C 29/08*** | (2006.01) |
| *B22F 1/00* | (2006.01) |

(52) U.S. Cl.

CPC ..... *C22C 29/08* (2013.01); *B22F 1/0011* (2013.01); *Y10T 407/27* (2015.01); *Y10T 408/89* (2015.01)

(58) Field of Classification Search

CPC ..... B22F 1/0011; C22C 29/08
USPC ..... 419/11, 32
See application file for complete search history.

(56) References Cited

U.S. PATENT DOCUMENTS

| | | | | |
|---|---|---|---|---|
| 4,539,041 | A | 9/1985 | Figlarz et al. | |
| 5,441,693 | A | 8/1995 | Ederyd et al. | |
| 5,505,902 | A | 4/1996 | Fischer et al. | |
| 5,619,000 | A | 4/1997 | Ederyd et al. | |
| 5,773,735 | A | 6/1998 | Dubensky et al. | |
| 5,976,213 | A | 11/1999 | Rolander et al. | |
| 6,019,813 | A * | 2/2000 | Gorge et al. | 75/255 |
| 6,214,287 | B1 | 4/2001 | Waldenström | |
| 6,346,137 | B1 | 2/2002 | Hohne et al. | |
| 6,352,571 | B1 | 3/2002 | Waldenström | |
| 6,626,975 | B1 * | 9/2003 | Gries et al. | 75/228 |
| 7,285,241 | B2 * | 10/2007 | Puide | 264/625 |
| RE40,785 | E | 6/2009 | Waldenström | |

FOREIGN PATENT DOCUMENTS

| | | |
|---|---|---|
| JP | 60-138042 | 7/1985 |
| JP | 11-256207 | 9/1999 |
| JP | 2000-319735 | 11/2000 |
| JP | 2001-524885 | 12/2001 |
| JP | 2006-037160 | 2/2006 |

OTHER PUBLICATIONS

Office Action for Swedish Patent Application No. 0900559-6, dated Oct. 28, 2009.
Office Action (and English translation) for Chinese Patent Application No. 201080017545.3, dated Apr. 3, 2013.
A. Ekstrand, et al.; "*A Solution Synthetic Route to Nanophase Cobalt Film and Sponge*," Chemistry of Materials, 2005, 17(1), pp. 199-205 (abstract only).
Second Office Action (and English translation) for Chinese Application No. 201080017545.3, dated Feb. 20, 2014.
Office Action (and English translation) for Japanese Application No. 2012-508429, dated Feb. 18, 2014.
International Search Report for PCT/SE2010/000109.

* cited by examiner

*Primary Examiner* — Roy King
*Assistant Examiner* — Ngoclan T Mai
(74) *Attorney, Agent, or Firm* — Morgan, Lewis & Bockius LLP

(57) ABSTRACT

The present invention relates to a cemented carbide with a homogeneous and dense microstructure of hard constituents in a well distributed binder phase based on Co and/or Ni with a porosity of AOO-BOO according to ISO 4505. The cemented carbide has a nanoporosity of less than 2.5 pores/1000 $\mu m^2$ with a size of 0.5-1 μm. The cemented carbide is produced by using a binder phase powder with a specific surface area of 3 to 8 $m^2/g$ with a sponge shape and a grain size of the sponge shaped particles of between 1 and 5 μm.

11 Claims, 3 Drawing Sheets

0,2 μm 0,2 μm

1 μm

CEMENTED CARBIDE TOOLS

RELATED APPLICATIONS

The present application is a U.S. National Phase Application of International Application No. PCT/SE2010/000109 (filed 26 Apr. 2010) which claims priority to Swedish Application No. 0900559-6 (filed 27 Apr. 2009).

The present invention relates to a WC—Co-based cemented carbide with excellent properties particularly for use as a tool for woodworking, printed circuit board drilling and wire drawing but also for metal cutting operations.

Cemented carbide bodies are generally manufactured by mixing powders of WC, TiC, NbC, TaC, Ni and/or Co and a pressing agent (typically wax-based) by wet milling in a ball mill to a slurry, spray-drying the slurry to a flowable ready-to-press powder which is compacted to bodies of desired shape and dimension which are subsequently sintered.

Generally, Co or Ni powders usually have a broad particle size distribution and strongly agglomerated particles with a worm like structure, see FIG. 1. The powders are difficult to deagglomerate, even by attritor milling. At low content of binder phase this may lead to binder-phase lakes and a heterogeneous microstructure resulting in varying physical and chemical properties.

The binder phase powders disclosed in U.S. Pat. No. 6,346,137, predominately have near-spherical grains with grain aggregates and an average particle size of 0.5-2 μm, see FIG. 2. This powder has a small specific surface area (SSA), which also gives problems to get a homogenous cemented carbide structure at low binder phase content.

Another binder phase powder is disclosed in U.S. Pat. No. 4,539,041. The powder has a particle submicron grainsize of a spherical shape, see FIG. 3. The use of such powders as binder phase in cemented carbides is described in U.S. Pat. No. 5,441,693. By using such powder the microstructure becomes more homogeneous through better dispersion of the binder phase particles. Thereby fewer binder phase-lakes are present after sintering and further the sintering temperature may be decreased.

Small grain size and/or low binder phase content will give higher hardness. Usually, a compromise has to be reached between grain size and binder phase content in order to get an optimal sinterability, e.g., low porosity of the cemented carbide at low sintering temperature. A very fine grain size cemented carbide usually necessitates a higher content of binder phase than slightly coarser grain size cemented carbide in order to have the WC grains being wet properly and homogeneously by the binder phase. The wetting of the binder phase onto the WC particles is also influenced by the dispersion and distribution of the binder phase before the sintering and the WC particles need to be very well deagglomerated and/or separated to get a large specific area. In order for the cemented carbide to work optimal it is important that the microstructure is as homogeneous as possible.

At low content of binder phase in a very fine grain cemented carbide a porosity can be observed which is so fine that it can not be observed in a light optical microscope and, thus, the ISO 4505 is not applicable. This nano-size porosity can be observed in a Scanning Electron Microscope (SEM) in secondary electron mode at a magnification of ×5000. The pores size is less than 1 μm. To quantify the nano-porosity the number of pores in the size range between 0.5 and 1 μm is counted within five different areas of 1000 $\mu m^2$ each.

Such porosity has a negative influence on the wear resistance. This porosity can be minimized by sintering under pressure (Sinter-HIP) or by post-hipping of the cemented carbide.

FIGS. 1 to 3 show Scanning Electron microscope images of Co powders having a) a worm like structure FIG. 1 b) a near spherical shape with small SSA FIG. 2 c) a submicron grain size and spherical shape FIG. 3

Figure 1:
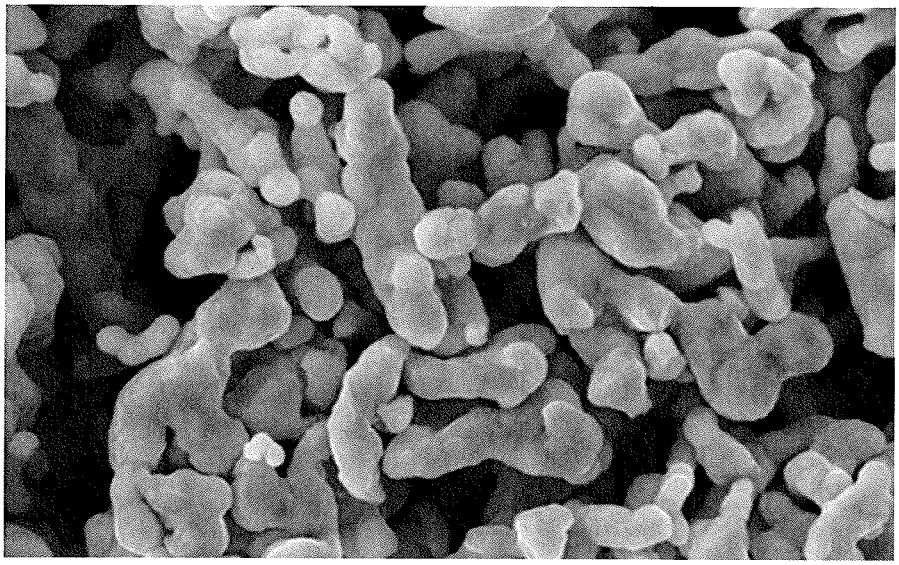
FIGURE 1 (PRIOR ART)

The object of the present invention is to provide a cemented carbide with improved sinterability particularly at fine WC grain size and/or low binder phase content.

In one aspect of the invention there is provided a method of making a sintered body comprising one or more hard constituents and a binder phase based on cobalt and/or nickel by powder metallurgical methods milling, pressing and sintering of powders wherein at least part of the binderphase powder has a specific surface area of 3 to 8 $m^2/g$ and a grain size of the binderphase powder particles of between 1 and 5 μm.

In another aspect of the invention there is provided a method of making a sintered body comprising one or more hard constituents and a binder phase based on cobalt and/or nickel by powder metallurgical methods milling, pressing and sintering of powders Wherein at least part of the binderphase powder has a specific surface area of 3 to 8 $m^2/g$ with a sponge shape and a grain size of the sponge shaped particles of between 1 and 5 μm.

According to the present invention a cemented carbide with improved sinterability based on tungsten carbide and a binder phase based on Ni and/or Co is provided made by powder metallurgical methods milling, pressing and sintering of powders forming hard constituents and binder phase if said Ni and/or Co powders suitably to more than 25%, preferably 50%, most preferably to 75%, consist of sponge shaped particles with a Fisher grain size of 1 to 5 μm with a specific surface area/BET of 3 to 8 $m^2/g$. The improved sinterability is shown as an essentially unchanged nanoporosity after reheating the sintered cemented carbide to 1370-1410° C. for about one hour in a protective atmosphere.

The present invention also relates to a cemented carbide, particularly useful for woodworking, printed circuit board drilling and wire drawing or metal cutting as well, with a homogeneous and dense microstructure with a well distributed binder phase with a porosity of A00-B00 according to ISO 4505 and a nanoporosity of <2.5 pores/1000 $\mu m^2$ as defined above. After a heat treatment at 1370-1410° C. for about one hour in a protective atmosphere the nanoporosity increases somewhat to less than 3 pores/1000 $\mu m^2$.

Preferably the total content of binder phase is <8 wt %, preferably 0.8-6 wt %, more preferably 1.5-4, wt %, more preferably 1.5-<3 wt %, most preferably 1.5-2.9 wt %.

Preferably the total content of binder phase is <8 wt %, preferably 0.8-6 wt %, most preferably 1.5-4 wt %, up to 5 wt-% of TiC+NbC+TaC and the remainder being WC. The average sintered WC grain size is preferably <1 μm, more preferably <0.8 μm.

In a first embodiment the composition of the binder phase is 40 to 80 wt % Co, preferably 50 to 70 wt % Co, most preferably 55 to 65 wt % Co, max 15 wt % Cr, preferably 6 to 12 wt % Cr and most preferably 8-11 wt % Cr, balance Ni, preferably 25 to 35 wt % Ni.

In a second embodiment the cemented carbide consists of 1.5 to 2.0 wt % Co, 0.4-0.8 wt % Ni and 0.2-0.4 wt % Cr, the rest being tungsten carbide with an average sintered WC grain size of <0.8 μm.

The cemented carbide can be provided with coatings known in the art.

The invention also relates to the use of a cemented carbide according to above as

- saw tips or inserts, for cutting and machining of wood and wood-based products, particularly chipboard, particle boards and medium or high density fiber boards (MDF/HDF),
- wire drawing dies or tools for cold forming operations,
- printed circuit board drills and burrs or
- coated or uncoated inserts for chipforming machining of metals.

Example 1

Inserts for a milling cutter were prepared from the following alloys A-D. The inserts were sintered in a sinter-hip furnace according to a conventional manufacturing route at 1410° C. with a pressure of 6 MPa during the sintering step.

Figure 4:
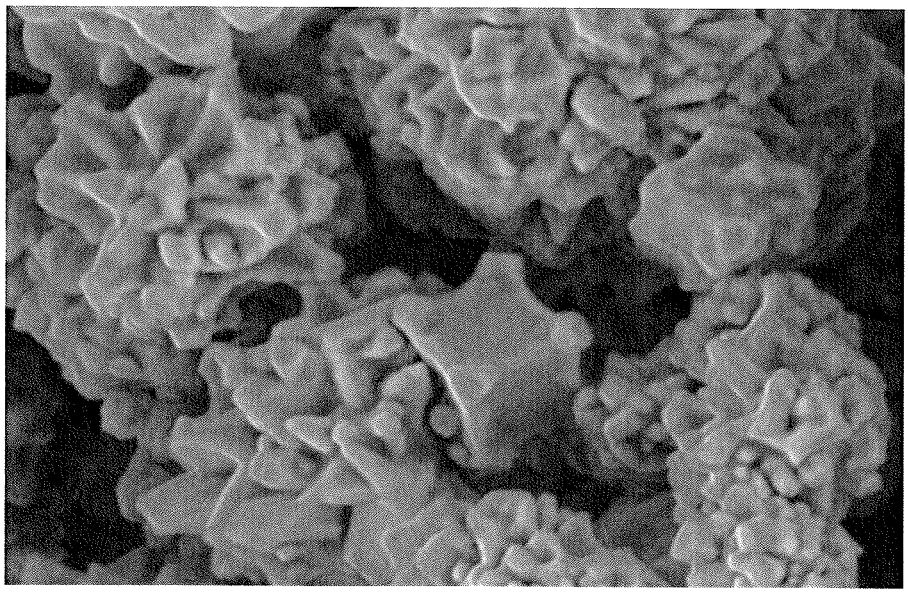
FIG. 4 shows a Scanning Electron microscope image of a Co-powder with sponge shaped particles, used in the present invention.
Figure 5:
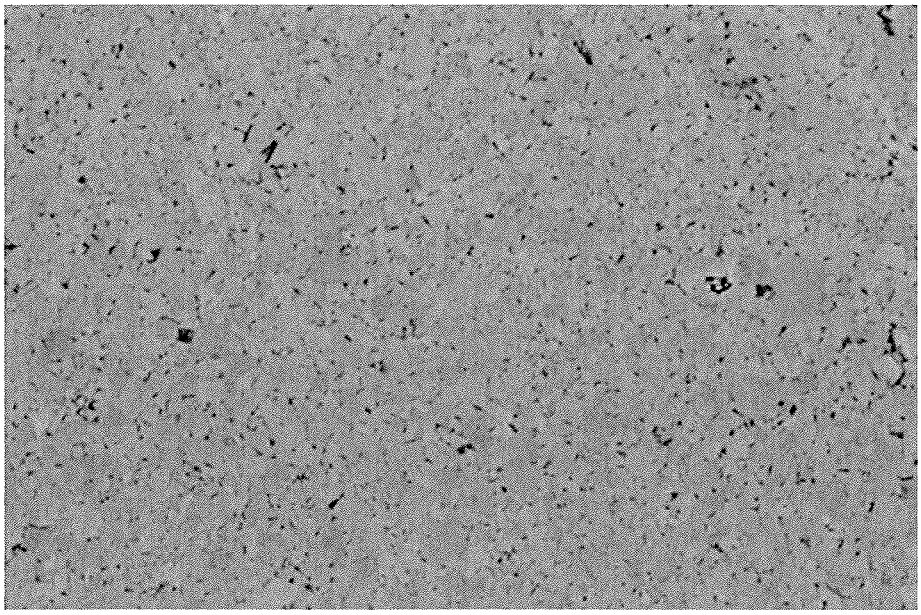
FIG. 5 is a Scanning Electron microscope image of the microstructure of a cemented carbide showing nanoporosity.

A first cemented carbide (A) according to the invention consisting of 1.9 wt % Co, 0.7 wt % Ni and 0.3 wt % Cr, the rest being tungsten carbide with an average grain size of 0.5 μm according to FSSS. The commercially available Co and Ni-powders had a sponge structure with an FSSS (Fisher Subsieve Sizer) grain size of 1.5 μm and a specific surface area with a BET of 4 $m^2/g$, see FIG. 4.

Figure 3:
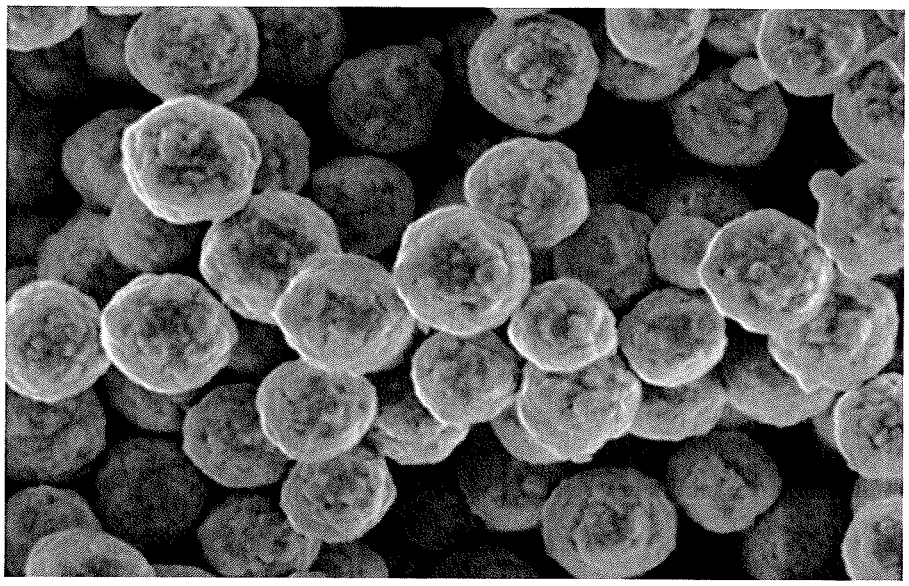
FIGURE 3 (PRIOR ART)

A second cemented carbide (B) with the same composition as A and with the same WC grain size. In this case polyol Co and Ni powders of spherical shape with an FSSS grain size of 0.7 μm and a BET specific surface area of 2 $m^2/g$ were used, see FIG. 3.

A third cemented carbide (C) with the same composition as A with the same WC grain size. In this case the Co and Ni powders used were made from hydroxides which are the industrial benchmark for making cemented carbide. The FSSS particle size was 0.9 μm and the BET specific surface area 2 $m^2/g$, see FIG. 1.

Figure 2:
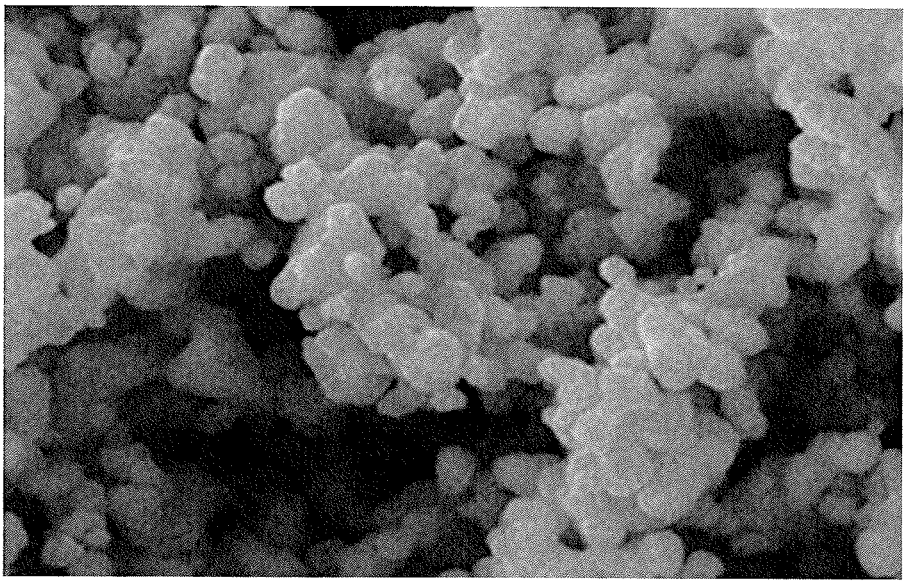
FIGURE 2 (PRIOR ART)

A fourth cemented carbide (D) with the same composition as A with the same WC grain size. In this case the Co and Ni powders used were made from the carbonyl decomposition process. The FSSS particle size was 0.9 μm and the BET specific surface area 1.8 $m^2/g$, see FIG. 2.

A fifth cemented carbide (E) according to the invention consisting of 1.9 wt % Co, 0.7 wt % Ni and 0.3 wt % Cr, the rest being tungsten carbide with an average grain size of 0.5 μm according to FSSS. The commercially available Ni-powder had a sponge structure with an FSSS (Fisher Subsieve Sizer) grain size of 1.5 μm and a specific surface area with a BET of 4 $m^2/g$. The Co powder was a polyol Co powder of spherical shape with an FSSS grain size of 0.7 μm and a BET specific surface area of 2 $m^2/g$. The fraction of sponge shaped binderphase powder was thus about 27 wt %.

The inserts were analyzed metallurgically with regard to density, hardness, porosity and nanoporosity. The nanoporosity was determined in a Scanning Electron Microscope in secondary electron mode at 5000× magnification and is reported as number of pores/1000 $\mu m^2$ as defined above. The average sintered WC grain size was determined from micrographs obtained from a Scanning Electron Microscope with a field emission gun (FEG-SEM). The evaluation was made by using a semi-automatic equipment and taking geometry effects into consideration.

Results

| Alloy | Density, $g/cm^3$ | Grain size μm | Hardness, HV3 | Porosity, ISO 4505 | Nanoporosity pores/1000 $\mu m^2$ |
|---|---|---|---|---|---|
| A | 15.34 | 0.7 | 2280 | A00-B00 | 2 |
| B | 15.17 | 0.7 | 2250 | A00-B00 | 6 |
| C | 14.88 | 0.7 | 2080 | A02-B00 | >20 |
| D | 15.02 | 0.7 | 2100 | A00-B00 | 12 |
| E | 15.26 | 0.7 | 2260 | A00-B00 | 2.4 |

A heat treatment in Argon atmosphere at 1400° C. for one hour was performed on alloys A, B and D. A metallurgical investigation gave a different nanoporosity level from the cross section areas. The FEG-SEM pictures at magnification ×5000 from the surface and the bulk of alloy A gave 2.5 pores/1000 $\mu m^2$. Alloy B showed 20 pores/1000 $\mu m^2$. Alloy D showed more than 20 pores/1000 $\mu m^2$.

Example 2

A test comprising machining of fiberboard of HDF-type with a side cutter ø125 mm containing three identical indexable inserts from Example 1. The cutting speed was 4500 rpm or 29 m/s, the feed rate 10 m/min and cutting depth 2 mm. As a measure of wear of the edge line the radius of the edge was determined after 2000 and 10000 m distance with the following result:

| Cutting Distance (m) | Wear of A, invention (μm) | Wear of B, prior art (μm) | Wear of C, prior art (μm) | Wear of D, prior art (μm) | Wear of E, invention (μm) |
|---|---|---|---|---|---|
| 2000 | 14 | 21 | 45 | 32 | 14 |
| 10000 | 30 | 49 | n.a. | 65 | 40 |

It is obvious from the test results that the wear of the inserts made according to the invention, A, decreases by more than 33% compared to the best prior art, B.

Example 3

A wire drawing test of drawing dies of cemented carbides of A, B and C from Example 1 was performed. The dies were ground and polished at the same time. The test runs were performed in a production drawing machine for drawing of steel wire: AISI 1005. The dies drew one after the other under the same working conditions. Three dies of each variant were used in the wire drawing test.

Working conditions:

Drawing speed: 25 m/s

Incoming diameter of the die: 0.26 mm

Internal profile of the die: 2 alfa=10°, bearing 0.15×d1 (0.23×0.15 mm)

The concentricity of the dies was measured after 40 and 80 km. The wear profile of the cross section of the drawing channel was measured in a Wyko optical profilometer.

Results Concentricity:

For all dies a wear ring was observed in the contact area of the cemented carbide from the incoming diameter of the wire.

| Drawing Distance (km) | A, invention Ovalization (mm) | B, prior art Ovalization (mm) | C, prior art Ovalization (mm) |
|---|---|---|---|
| 40 | 0.005 | 0.005 | 0.010 |
| 80 | 0.010 | 0.030 | 0.065 |

Variant B showed uneven ovalization between the three dies after 80 km. One of the dies had 0.120 mm ovalization.

Wear results from Wyko profilometer.

Optical scans of the drawing channel were made along the channel and across the channel of the dies.

| Drawing Distance (km) | A, invention Wear: Ra (μm) | B, prior art Wear: Ra (μm) | C, prior art Wear: Ra (μm) |
|---|---|---|---|
| 80 | 0.05 | 0.20 | 0.45 |

The difference in the wear (Ra values) is explained by a pronounced pitting of WC grains in the wear flat surface especially for variant C. The dies made according to the invention had intact wear surfaces with a high smoothness and showed the best performance results with regard to concentricity and wear behaviour.

Example 4

Sawing Application

The sawing of bars and tubes of aluminium alloy JIS AC2B gives problem with build up edges (BUE) and problem with pitting of Cemented Carbide grains in the cutting edge line. Alloy JIS AC2B is characterized by a significant content of Si and Cu. The Cemented Carbide grades used in this application are therefore chosen with regards to low content of binder phase and high wear resistance.

A dry sawing test has been performed with the grade composition according to Example 1. Grade D is the commodity grade in this sawing application and grade A, according to the invention and grade B has been used in a sawing test of solid aluminum bars (JIS AC2B) with a rectangular cross section; size 200×20 mm. The circular saw with OD of 300 mm and 48 saw tips of Type SW167, (Sandvik) has been chosen in the test.

The cutting edges of the sawtips were ground to high sharpness and before the cutting test a gentle edge treatment was performed with a diamond file.

The cutting condition:

Cutting speed: 80 m/sec

Feed rate: 40 mm/sec

Rake angle: 15°

Relief angle: 6°

The cutting procedure has been evaluated by measuring the cutting force. The edge wear was measured after the cutting length of 10 m and 100 m respectively.

The cutting has been performed during dry cutting with sprayed lubricants (synthetic ester).

Wear resistance

| Cutting length (m) | A, invention Edge wear (mm) | B, prior art Edge wear (mm) | D, prior art Edge wear (mm) |
|---|---|---|---|
| 10 | 0.18 | 0.23 | 0.31 |
| 100 | 0.32 | 0.40 | 0.46 |

Remark: The cutting surface of the aluminium bar was dull with a surface roughness of Ry>6 μm and not approved after 100 m from the cutting procedure with saw B and D. According to the invention the surface roughness was Ry=2 μm.

The cutting force was almost two times higher at 100 m for saw B and D in comparison to saw A.

The wear of the saw tips was characterised by micro- and macro abrasion due to WC-fragmentation and removal of fragments/chips from the carbide skeleton. The saw according to the invention was characterised by a good edge retention and higher wear resistance than prior art.

Example 5

A turning test has been devised which simulates microdrilling of printed circuit board (PCB).

A stack of 20-30 discs was cut from PCB panels and mounted on to an arbour which is then rotated in the chuck of a lathe. A specially ground and very sharp edged tool bit with rake and clearance angles closely matching those of microdrills is used to turn the outer diameter of the stack at a feed per revolution of 50% that typically used by twin edged microdrills. The diameter and thickness of the stack is chosen so as to represent a helical drilled distance that is approximately equivalent to 5000 normal depth 0.3 mm diameter drilled holes.

It has been shown a good agreement between wear magnitudes observed in this turning test with those observed in actual PCB microdrilling tests.

Cemented carbide (A) according to the invention in Example 1 has been found to have better wear resistance than established PCB machining grades in the above described turning test. At a cutting speed of 100 m/min, a feed rate of 0.010 mm/rev and a depth of cut of 0.25 mm it was found that Cemented carbide (A) gave a flank wear land width of 36 μm over a helical cutting distance of 1260 m.

By comparison a normal 6% cobalt 0.4 μm tungsten carbide PCB routing grade gave a wear land of 46 μm.

At a cutting speed of 200 m/min using the same feed rate and depth of cut but over a helical distance of 1250 m Cemented carbide (A) gave a flank wear land of 32 μm compared with 37 μm for the conventional 6% cobalt grade.

At a high cutting speed of 400 m/min, again using the same feed rate and depth of cut, over a helical distance of 1230 m Cemented carbide (A) gave a flank wear land width of 28 μm compared with 36 μm for the conventional 6% cobalt grade. In all above tests no edge chipping has occurred.

Also a comparison was made between Cemented carbide (A) and a WC—Co grade according to prior art with 3% cobalt and 0.8 μm grain size.

At a cutting speed of 100 m/min, feed 0.010 mm/rev and 0.25 mm depth of cut the 3% cobalt grade gave irregular flank wear with a maximum width of 73 μm after cutting for a helical distance of 1260 m. This grade showed edge microchipping due to a lack of toughness.

Despite the low binder phase content in grade (A) the test gave no edge microchipping and uniform wear of 36 μm as stated above.

The invention claimed is:

1. Method of making a sintered body comprising one or more hard constituents and a binder phase based on cobalt and/or nickel by powder metallurgical methods including milling, pressing and sintering of powders, wherein at least part of the binder phase powder includes particles having a specific surface area of 3 to 8 $m^2/g$ and a grain size of between 1 and 5 μm, and wherein the sintered body has a homogeneous and dense microstructure of hard constituents distributed in the binder phase, a porosity of AOO-BOO according to ISO 4505, and a nanoporosity of less than 3 pores/1000 $\mu m^2$ after a heat treatment at 1370-1410° C. for about one hour in a protective atmosphere.

2. Method according to claim 1 wherein the at least part of the binder phase powder has a sponge shape.

3. Method according to claim 1 wherein the sintered body is a cemented carbide with a total content of binder phase of <8 wt %, <5 wt % of TiC+NbC+TaC and the remainder being WC with a grain size of <1 μm.

4. Method according to claim 3 wherein a total content of binder phase is 0.8-6 wt %.

5. Method according to claim 3 wherein a total content of binder phase is 1.5-4 wt %.

6. Method according to claim 3 wherein the sintered body has a WC grain size <0.8 μm.

7. Method according to claim 3 wherein the sintered body has a WC grain size <0.5 μm.

8. Method according to claim 1 wherein the binder phase powder consists of Co particles having a specific surface area of 3 to 8 $m^2/g$, a grain size of between 1 and 5 μm, and a sponge shape.

9. Method according to claim 1 wherein the nanoporosity is less than 2.5 pores/1000 $\mu m^2$.

10. Method according to claim 1 wherein the sintered body is a cemented carbide with a total content of binder phase of 1.5 to 2.9 wt %, <5 wt % of TiC+NbC+TaC and the remainder being WC with a grain size of <1 μm.

11. Method according to claim 1 wherein more than 25% of the binder phase powder has a specific surface area of 3 to 8 $m^2/g$.

* * * * *